US006553689B2

(12) United States Patent
Jain et al.

(10) Patent No.: US 6,553,689 B2
(45) Date of Patent: Apr. 29, 2003

(54) VAPOR COLLECTION METHOD AND APPARATUS

(75) Inventors: Nirmal K. Jain, Maple Grove, MN (US); Peter T. Benson, North St. Paul, MN (US); James L. Capps, Moundville, MO (US); William Blake Kolb, St. Paul, MN (US); Eldon E. Lightner, Nevada, MO (US); Norman L. Rogers, Jr., Nevada, MO (US); Robert A. Yapel, Oakdale, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/960,131

(22) Filed: Sep. 21, 2001

(65) Prior Publication Data

US 2002/0095818 A1 Jul. 25, 2002

Related U.S. Application Data

(60) Provisional application No. 60/235,214, filed on Sep. 24, 2000, provisional application No. 60/235,221, filed on Sep. 24, 2000, and provisional application No. 60/274,050, filed on Mar. 7, 2001.

(51) Int. Cl.[7] ..... F26B 3/00; D21F 11/00

(52) U.S. Cl. ..... 34/444; 34/448; 34/445; 34/468; 34/630; 34/631; 34/416; 162/204

(58) Field of Search ..... 34/448, 421, 463, 34/359, 362, 445, 467, 468, 630, 631, 241, 444, 416; 162/206, 207, 204

(56) References Cited

U.S. PATENT DOCUMENTS

| | | | | |
|---|---|---|---|---|
| 1,494,830 | A | 5/1924 | Cook | |
| 3,408,748 | A | 11/1968 | Dunn | |
| 4,012,847 | A | 3/1977 | Rand | |
| 4,053,990 | A | 10/1977 | Bielinski | |
| 4,462,169 | A | 7/1984 | Daane | |
| 4,894,927 | A | 1/1990 | Ogawa et al. | |
| 4,926,567 | A | 5/1990 | Ogawa | |
| 4,980,697 | A | 12/1990 | Eklund | |
| 5,168,639 | A | 12/1992 | Hebels | |
| 5,581,905 | A | 12/1996 | Huelsman et al. | |
| 5,694,701 | A | 12/1997 | Huelsman et al. | |
| 5,813,133 | A | 9/1998 | Munter et al. | |
| 5,980,697 | A | 11/1999 | Kolb et al. | |
| 6,047,151 | A | 4/2000 | Carvalho et al. | |
| 6,134,808 | A | 10/2000 | Yapel et al. | |
| 6,207,020 | B1 * | 3/2001 | Anderson | 162/207 |
| 6,280,573 | B1 * | 8/2001 | Lindsay et al. | 162/198 |
| 6,308,436 | B1 * | 10/2001 | Stipp | 34/422 |

FOREIGN PATENT DOCUMENTS

| | | |
|---|---|---|
| DE | 499 308 | 6/1930 |
| GB | 713 612 | 8/1954 |

OTHER PUBLICATIONS

Schiffbauer R: "Abluftreinigung Durch Losemittelruckgewinnung", Linde Berichte Aus Technik Und Wissenschaft, Linde AG. Wiesbaden, DE, No. 64, 1990, pp. 45–52, XP000114324.

* cited by examiner

*Primary Examiner*—Ira S. Lazarus
*Assistant Examiner*—K. B. Rinehart
(74) *Attorney, Agent, or Firm*—Brian E. Szymanski

(57) ABSTRACT

A vapor collection method and apparatus capable of capturing vapor compositions without substantial dilution. The method and apparatus utilize a material that has a surface with an adjacent gas phase. A chamber is positioned in close proximity to a surface of the material. The position of the chamber creates a relatively small gap between the surface of the material and the chamber. The adjacent gas phase between the chamber and the surface define a region possessing an amount of mass. At least a portion of the mass is drawn through the region by induced flow. The utilization of a small gap limits the flow of mass that is external to the chamber from being swept through the chamber by induced flow.

49 Claims, 4 Drawing Sheets

VAPOR COLLECTION METHOD AND APPARATUS

This application is claiming priority to U.S. Provisional Application Ser. Nos. 60/235,214, filed Sep. 24, 2000, 60/235,221, filed on Sep. 24, 2000, and 60/274,050, filed on Mar. 7, 2001, all of which are hereby incorporated by reference in their entirety. The present invention relates to a vapor collection method, and more particularly to a method that enables the collection of gas phase components without substantial dilution.

FIELD OF THE INVENTION

Background of the Invention

Conventional practices for the removal and recovery of components during drying of coated materials generally utilize drying units or ovens. Collection hoods or ports are utilized in both closed and open drying systems to collect the solvent vapors emitted from the substrate or material. Conventional open vapor collection systems generally utilize air handling systems that are incapable of selectively drawing only the desired gas phase components without drawing the ambient atmosphere. Closed vapor collection systems typically introduce an inert gas circulation system to assist in purging the enclosed volume. In either system, the introduction of ambient air or inert gas dilutes the concentration of the gas phase components. Thus the subsequent separation of vapors from the diluted vapor stream can be difficult and inefficient.

Additionally, the thermodynamics associated with the conventional vapor collection systems often permit the undesirable condensation of the vapor at or near the substrate or material. The condensate can then fall onto the substrate or material and adversely affect either the appearance or functional aspects of the material. In industrial settings, the ambient conditions surrounding the process and processing equipment may include extraneous matter. In large volume drying units, the extraneous matter may be drawn into the collection system by the large volumetric flows of the conventional drying systems.

It would be desirable to collect gas phase components without substantially diluting the gas phase components with ambient air or inert gases. Additionally, it would be an advantage to collect gas phase components at relatively low volumetric flows in an industrial setting in order to prevent the entrainment of extraneous matter.

SUMMARY OF THE INVENTION

The present invention provides a method and apparatus for transporting and capturing gas phase components without substantial dilution. The method and apparatus utilize a chamber in close proximity to the surface of a substrate to enable collection of gas phase components near the surface of the substrate.

In the method of the present invention, at least one material is provided that has at least one major surface with an adjacent gas phase. A chamber is then positioned in close proximity to the surface of the material to define a gap between the chamber and the material. The gap is preferably no greater than 3 cm. The adjacent gas phase between the chamber and the surface and the material defines a region possessing an amount of mass. At least a portion of the mass from the adjacent gas phase is transported through the chamber by inducing a flow through the region. The flow of the gas phase is represented by the equation:

$$M1+M2+M3=M4 \quad \text{(Equation I)}$$

wherein M1 is the total net time-average mass flow per unit width through the gap into the region and through the chamber resulting from pressure gradients, M2 is the time-average mass flow per unit width from the at least one major surface of the material into said region and through the chamber, M3 is the total net time-average mass flow per unit width through the gap into the region and through the chamber resulting from motion of the material, M4 is the time-average rate of mass transported per unit width through the chamber. For purposes of the invention the dimensions defining the width is the length of the gap in the direction perpendicular to the motion of the material and in the plane of the material.

The present method and apparatus is designed to substantially reduce the amount of dilution gas transported through the chamber. The use of a chamber in close proximity of the surface of the material and small negative pressure gradients enables the substantial reduction of dilution gas, namely M1. The pressure gradient, $\Delta p$, is defined as the difference between the pressure at the chambers lower periphery, pc, and the pressure outside the chamber, po, wherein $\Delta p = pc - po$. The value of M1 is generally greater than zero but not greater than 0.25 kg/second/meter. Preferably, M1 is greater than zero but not greater than 0.1 kg/second/meter, and most preferably, greater than zero but not greater than 0.01 kg/second/meter.

In an alternative expression, the average velocity resulting from M1 may be utilized to express the flow of dilution gas phase components entering the chamber. The use of a chamber in close proximity of the surface of the material, and small negative pressure gradients, enables the substantial reduction of the average total net gas phase velocity, $\langle v \rangle$, through the gap. For the present invention, the value of $\langle v \rangle$ is generally greater than zero but not greater than 0.5 meters/second.

The present method attempts to significantly reduce dilution of the gas phase component in the adjacent gas phase by substantially reducing M1 in Equation I. M1 represents the total net gas phase dilution flow into the region caused by a pressure gradient. The dilution of the mass in the adjacent gas phase may adversely affect the efficiency of gas phase collection systems and subsequent separation practices. For the present method, M1 is greater than zero but no greater than 0.25 kg/second/meter. Additionally, due to the relatively small gap between the chamber and the surface of the material, the volumetric flow rate of gas phase components through the gap caused by induced flow is generally no greater than 0.5 meters/second.

The method is well suited for applications requiring the desired collection of vaporous components in an efficient manner. Organic and inorganic solvents are examples of components that are often utilized as carriers to permit the deposition of a desired composition onto a substrate or material. The components are generally removed from the substrate or material by supplying a sufficient amount of energy to permit the vaporization of the solvent. It is desirable, and often necessary for health, safety, and environmental reasons, to recover the vaporous components after they have been removed from the substrate or material. The present invention is capable of collecting and transporting vapor components without introducing a substantial volume of a dilution stream.

In a preferred embodiment, the method of the present invention includes the use of material that contains at least one evaporative component. The chamber is positioned in close proximity to a surface of the material. Energy is then directed at the material to vaporize the at least one evaporative component to form a vapor component. At least a portion of the vapor component is captured in the chamber. The vapor component is generally captured at a high concentration that allows subsequent processing, such as separation, to become more efficient.

The apparatus of the present invention includes a support mechanism for supporting material. The material has at least one major surface with an adjacent gas phase. A chamber is placed in close proximity to a surface of the material to define a gap between the surface and the collection chamber. The adjacent gas phase between the chamber and the material defines a region containing an amount of mass. A mechanism in communication with the chamber induces the transport of at least a portion of the mass in the adjacent gas phase through the region. The transport of mass through the region into the chamber is represented by Equation I. The vapor in the chamber may optionally be conveyed to a separating mechanism for additional processing.

The method and apparatus of the present invention are preferably suited for use in transporting and collecting solvents from a moving web. In operation, the chamber is placed above the continuously moving web to collect vapors at a high concentration. The low volumetric flows and high concentrations of the vapor improve the efficiency of the solvent recovery and substantially eliminate contamination problems associated with conventional component collection devices.

The method and apparatus of the present invention are preferably used in combination with conventional gap drying systems. Gap drying systems generally convey a material through a narrow gap between hot plate and a condensing plate for the evaporation and subsequent condensation of evaporative components in the material. The configuration of the present apparatus, in various locations of a gap drying system, enables further capture of gas phase components which generally can be present in the adjacent gas phase on the surface of the material either prior to entering, or exiting a gap drying unit.

For purposes of the present invention, the following terms used in this application are defined as follows:

"time-average mass flow" is represented by the equation, $$MI = \frac{1}{t}\int_0^t mi\,dt,$$

wherein M1 is the time-average mass flow in kg/second, t is time in seconds, and mi is the instantaneous mass flow in kg/second;

"pressure gradient" means a pressure differential between the chamber and the external environment; and "induced flow" means a flow generally created by a pressure gradient.

Other features and advantages will be apparent from the following description of the embodiments thereof, and from the claims.

BRIEF DESCRIPTION OF THE DRAWINGS

The above, as well as other advantages of the present invention will become readily apparent to those skilled in the art from the following detailed description when considered in the light of the accompanying drawings in which.

DETAILED DESCRIPTION

Figure 1:
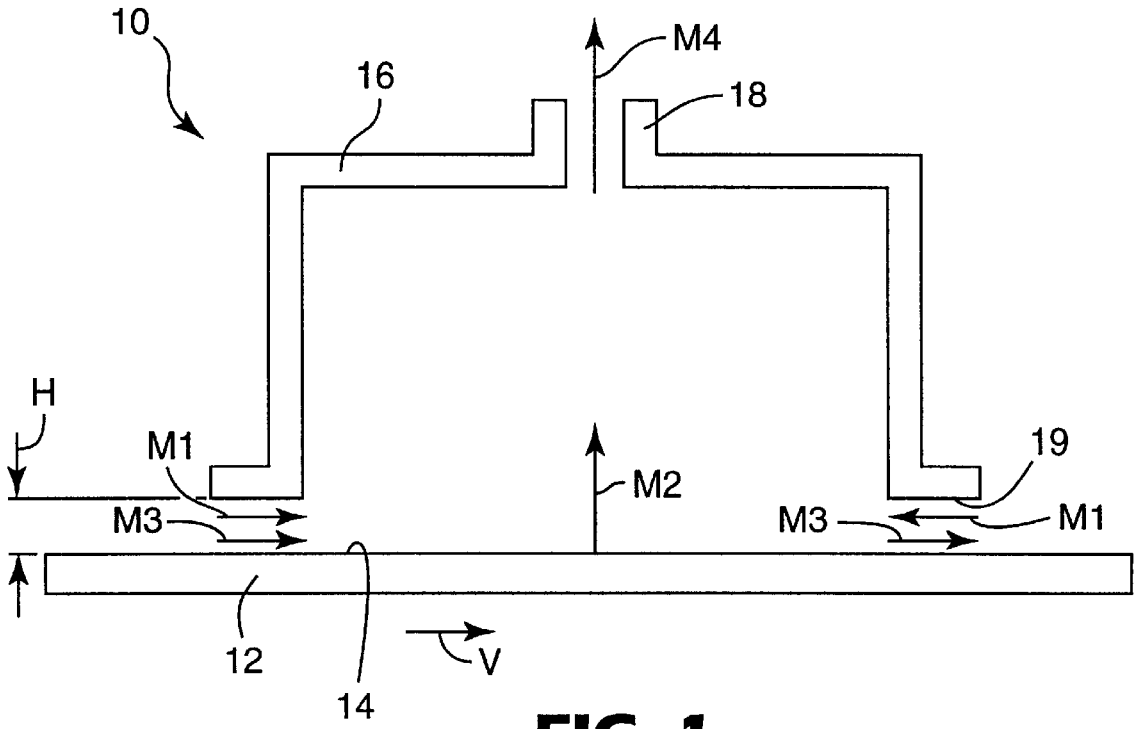
FIG. 1 is a schematic view of the present invention.

The method and apparatus 10 of the present invention are generally described in FIG. 1. The method includes providing a material 12 having at least one major surface 14 with an adjacent gas phase (not shown). A chamber 16, having an exhaust port 18 is positioned in close proximity to define a gap between the lower periphery 19 of the chamber 16 and the surface 14 of the material 12. The gap has a height H, which is preferably 3 cm or less. The adjacent gas phase between the lower periphery 19 of the chamber 16 and the surface 14 of the material 12 define a region possessing an amount of mass. The mass in the region is generally in a gas phase. However, those skilled in the art recognize that the region may also contain mass that is in either the liquid or solid phase, or combinations of all three phases.

At least a portion of the mass from the region is transported through the chamber 16 by induced flow. Flow may be induced by conventional mechanisms generally recognized by those skilled in the art. The flow of mass per unit width into and through the chamber are represented by Equation I:

$$M1+M2+M3=M4 \qquad \text{(Equation I)}$$

FIG. 1 depicts the various flow streams encountered in practicing the method of the present invention. M1 is the total net time-average mass flow per unit width through the gap into the region and through the chamber resulting from pressure gradients. For purposes of the present invention, M1 essentially represents a dilution stream. M2 is the time-average mass flow per unit width from the at least one major surface of the material into said region and through the chamber. M3 is the total net time-average mass flow per unit width through the gap into the region and through the chamber resulting from motion of the material. M3 is generally recognized as mechanical drag and covers both the mass pulled in by the motion of the material under the chamber and the mass exiting from underneath the chamber as the material passes. In cases where the material is static under the chamber, M3 would be zero. In case where the gap H is uniform (i.e., the gap at the entrance and exit of the chamber are equal) M3 is zero. M3 is non zero when the entrance and exit gaps are non uniform (i.e., not equal). M4 is the time-average rate of mass transported per unit width through the chamber. It is understood that mass can be transported through the gap and into the region without being transported through the chamber. Such flows are not included in the total net flows included in Equation 1. For purposes of the invention the dimension defining the width is the length of the gap in the direction perpendicular to the motion of the material and in the plane of the material.

The present method and apparatus is designed to substantially reduce the amount dilution gas transported through the chamber. The use of a chamber in close proximity of the surface of the material and extremely small negative pressure gradients enables the substantial reduction of dilution gas, namely M1. The pressure gradient, $\Delta p$, is defined as the difference between the pressure at the chambers lower periphery, pc, and the pressure outside the chamber, po, wherein $\Delta p = pc - po$. The value of M1 is generally greater than zero but not greater than 0.25 kg/second/meter. Preferably, M1 is greater than zero but not greater than 0.1 kg/second/meter, and most preferably, greater than zero but not greater than 0.01 kg/second/meter.

In an alternative expression, the average velocity resulting from M1 may be utilized to express the flow of dilution gas phase components through the chamber. The use of a chamber in close proximity of the surface of the material, and small negative pressure gradients, enables the substantial reduction of the total net average gas phase velocity, $\langle v \rangle$, through the gap. The average gas phase velocity resulting from M1 is defined as; $\langle v \rangle = M1/\rho A$. Wherein M1 is defined above, $\rho$ is the gas stream density in kg/cubic meter and A is the cross sectional area available for flow into the region in square meters. Wherein, $A = H(2w+2l)$ where H is defined above, w is the length of the gap in the direction perpendicular to the motion of the material, and 1 is the length of the gap in the direction of material motion. For the present invention, the value of $\langle v \rangle$ is generally greater than zero but not greater than 0.5 meters/second.

The close proximity of the chamber to the surface, and the relatively small pressure gradient, enable the transport of the mass in the adjacent gas phase through the chamber with minimal dilution. Thus lower flow rates at higher concentrations may be transported and collected. The present method is also suitable for transporting and collecting relatively small amounts of mass located in the adjacent gas phase. The gap height is generally 3 cm or less, preferably 1.5 cm or less, and most preferably 0.75 cm or less. Additionally, in a preferred embodiment, the gap is substantially uniform around the periphery of the chamber. However, the gap may be varied, or non-uniform for specific applications. In a preferred embodiment, the chamber may have a periphery wider than the material, or web conveyed under the chamber. In such cases, the chamber can be designed to seal the sides to further reduce time-average mass flow per unit width from pressure gradients (M1). The chamber can also be designed to conform to different geometry material surfaces. For example, the chamber can have a radiused lower periphery to conform to the surface of a cylinder.

The material utilized may include any material that is capable of being positioned in close proximity of the chamber. The preferred material is a web. The web may include one or more layers of material or coatings applied onto a substrate.

The chamber is sized and operated appropriately to provide the sufficient collection of gas phase components without substantial dilution or without excessive loss of gas phase components for failure to draw them into the chamber. Those skilled in the art are capable of designing and operating a chamber to address both the evaporation rate of given materials and the needed fluid flow rate for proper recovery of the gas phase components. With flammable gas phase components, it is preferred to capture the vapors at concentrations above the upper flammability limit for safety reasons. Additionally, the gap may be maintained over a substantial portion of the web. Several chambers may also be placed in operation at various points along the web processing path. Each individual chamber may be operated at different pressures, temperatures and gaps to address process and material variants.

Transport of the mass from the region through the chamber is accomplished by inducing a pressure gradient. A pressure gradient is generally created by mechanical devices, for example, pumps, blowers, and fans. The mechanical device that induces the pressure gradient is in communication with the chamber. Therefore, the pressure gradient will initiate mass flow through the chamber and through an exhaust port in the chamber. Those skilled in the art also recognize that pressure gradients may also be derived from density gradients of gas phase components.

The chamber may also include one or more mechanisms to control the phase of the mass transported through the chamber thereby controlling phase change of the components in the mass. For example, conventional temperature control devices may be incorporated into the chamber to prevent condensation from forming on the internal portions of the chamber. Non-limiting examples of conventional temperature control devices include heating coils, electrical heaters, and external heat sources. A heating coil provides sufficient heat in the chamber to prevent the condensation of the vapor component. Conventional heating coils and heat transfer fluids are suitable for use with the present invention.

Depending on the specific gas phase composition, the chamber may optionally include flame arresting capabilities. A flame arresting device placed internally within the chamber allows gases to pass through but stops flames in order to prevent a fire or explosion. A flame is a volume of gas in which a self-sustaining exothermic (heat producing) chemical reaction occurs. Flame arresting devices are generally needed when the operating environment includes oxygen, high temperatures and a flammable gas mixed with the oxygen in suitable proportions to create a combustible mixture. A flame arresting device works by removing one of the noted elements. In a preferred embodiment, the gas phase components pass through a narrow gap bordered by heat absorbing materials. The size of both the gap and the material are dependent upon the specific vapor composition. For example, the chamber may be filled with expanded metallic heat-absorbing material, such as for example aluminum, contained at the bottom by a fine mesh metallic screen with mesh openings sized according to the National Fire Protection Association Standards.

Optional separation devices and conveying equipment utilized in the present invention may also possess flame arresting capabilities. Conventional techniques recognized by those skilled in the art are suitable for use with the present invention. The flame arresting devices are utilized in the chamber and the subsequent processing equipment without the introduction of an inert gas. Thus the concentration of the vapor stream is generally maintained to enable efficient separation practices.

The present method is suitable for the continuous collection of a gas phase composition. The gas phase composition generally flows from the chamber to a subsequent processing step, preferably without dilution. The subsequent processing steps may include such optional steps as, for example, separation or destruction of one or more components in the gas phase. The separation processing step may occur internally within the chamber in a controlled manner, or it may occur externally. Preferably, the vapor stream is separated using conventional separation processes such as for example absorption, adsorption, membrane separation or condensation. The high concentration and low volumetric flows of the vapor composition enhance the overall efficiency of conventional separation practices. Most preferably, at least a portion of the vapor component is captured at concentrations high enough to permit subsequent separation of the vapor component at a temperature of 0° C. or higher. This temperature prevents the formation of frost during the separation process which has both equipment and process advantages.

The vapor stream from the chamber may contain either the vapor, or vapor and liquid phase mixture. The vapor stream may also include particulate matter which can be filtered prior to the separation process. Suitable separation process may include, for example, conventional separation practices such as: concentration of the vapor composition in the gaseous stream; direct condensation of the dilute vapor composition in the gaseous stream; direct condensation of the concentrated vapor composition in the gaseous stream; direct two stage condensation; adsorption of the dilute vapor composition in the gaseous stream using activated carbon or synthetic adsorption media; adsorption of the concentrated vapor composition in the gaseous stream using activated carbon or synthetic adsorption media; absorption of the dilute vapor phase component in the gaseous stream using media with high absorbing properties; and absorption of the concentrated vapor phase component in the gaseous stream using media with high absorbing properties. Destruction devices would include conventional devices such as thermal oxidizers. Optionally, depending upon the composition of the gas phase component, the stream may be vented or filtered and vented after exiting the chamber.

Figure 2:
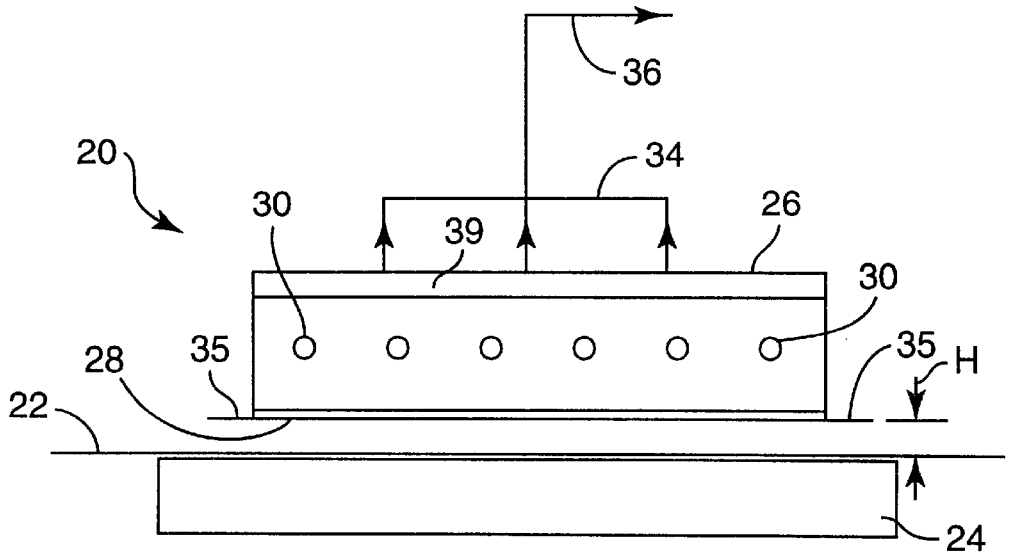
FIG. 2 is a schematic view of a preferred embodiment of a gas phase collection apparatus of the present invention.
Figure 3:
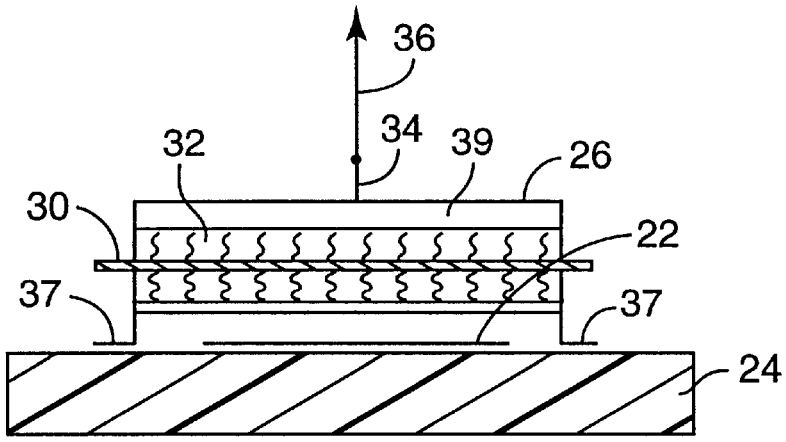
FIG. 3 is a cross-sectional view of a preferred embodiment of a gas phase collection apparatus of the present invention.
Figure 4:
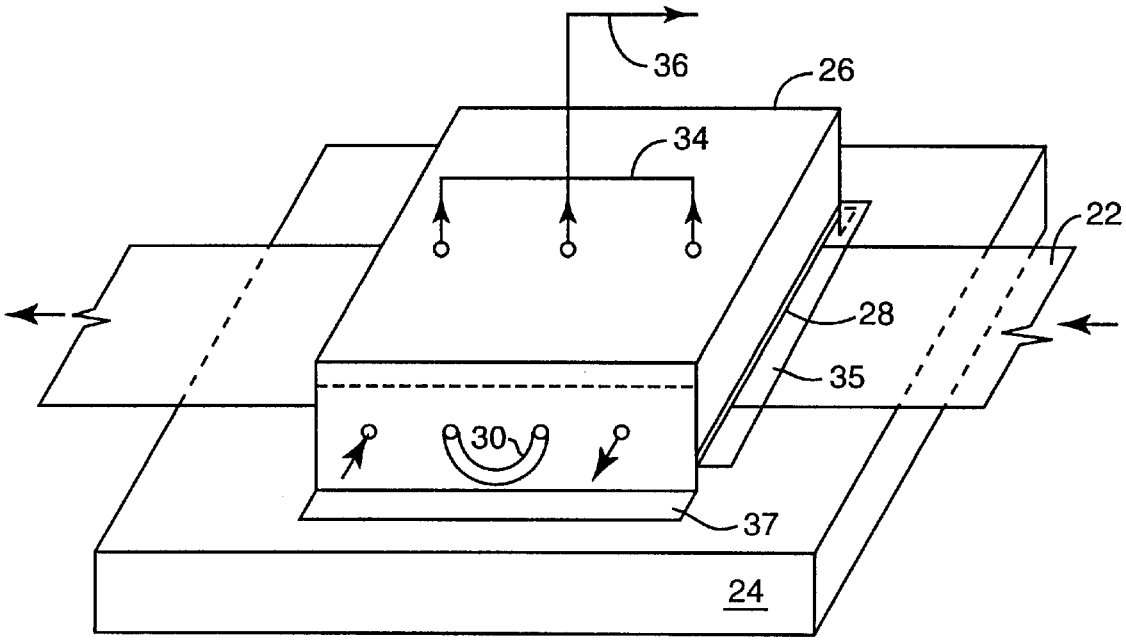
FIG. 4 is an isometric view of preferred embodiment of a gas phase collection apparatus of the present invention.

One preferred embodiment of the present invention is described in FIGS. 2–4. The inventive apparatus 20 includes a web 22 conveyed by a web conveying system (not shown) between a heating element 24 and a chamber 26. The web 22 comprises a material containing at least one evaporative component (not shown). The chamber 26 includes a lower periphery 28. The chamber 26 is positioned in close proximity to the web 22 such that the lower periphery 28 of the chamber 26 defines a gap H between the chamber and the web 22. The chamber 26 optionally includes a heating coil 30, flame arresting elements 32 and a head space 39 above flame arresting elements 32. A manifold 34 provides a connection to a pressure control mechanism (not shown). The manifold 34 ultimately provides an outlet 36 to convey the vapors to subsequent processing steps.

In operation, the heating element 24 provides primarily conductive thermal energy to the bottom side of the web material 22 to vaporize the evaporative component in the web material. The chamber 26 is operated with a pressure gradient so that as the vapors evolve from the web material 22 at least a portion are conveyed across the vertical gap H and into the chamber 26. The vapors drawn into the chamber 26 are conveyed through the manifold 34 and the outlet 36 for further processing. The gap H and the pressure gradient permit the capture of the vapors in the chamber 26 without substantial dilution.

The preferred embodiment is directed to transporting and collecting evaporative components from materials. The evaporative component may be included within the material, on the surface of the material, or in the adjacent gas phase. Materials include, for example, coated substrates, polymers, pigments, ceramics, pastes, wovens, non-wovens, fibers, powders, paper, food products, pharmaceutical products or combinations thereof. Preferably, the material is provided as a web. However, either discrete sections or sheets of materials may be utilized.

The material includes at least one evaporative component. The evaporative component is any liquid or solid composition that is capable of vaporizing and separating from a material. Non-limiting examples would include organic compounds and inorganic compounds or combinations thereof, such as water or ethanol. In general, the evaporative component may have originally been used as a solvent for the initial manufacturing of the material. The present invention is well suited for the subsequent removal of the solvent.

In accordance with the present invention, a sufficient amount of energy is applied to the material to vaporize at least one evaporative component. The energy needed to vaporize the evaporative component may be applied through radiation, conduction, convection or combinations thereof. Conductive heating, for example could include passing the material in close proximity to a flat heated plate, curved heated plate or partially wrapping the material around a heated cylinder. Examples of convective heating may include directing hot air by nozzle, jet or plenum at the material. Electromagnetic radiation such as radio frequency, microwave energy, or infrared energy, may be directed at the material and absorbed by the material causing internal heating of the material. Energy may be applied to any or all surfaces of the material. Additionally, the material may be supplied with sufficient internal energy, for example a preheated material or an exothermic chemical reaction occurring in the material. The energy application techniques may be used individually or in combination.

Those skilled in the art recognize that the energy for heating may be supplied from conventional sources. For example, sufficient energy may be provided by electricity, the combustion of fuels, or other thermal sources. The energy may be converted to heat directly at the application point, or indirectly through heated liquids such as water or oil, heated gasses such as air or inert gas or heated vapors such as steam or conventional heat transfer fluids.

The chamber of the present invention is positioned in close proximity to the material in order to form a gap between the lower periphery of the chamber and the material. The gap is preferably a substantially uniform spatial distance between the surface of the material and the bottom of the chamber. The gap distance is preferably 3 centimeters or less, most preferably 1.5 centimeters or less, and even more preferably 0.75 centimeters or less. The chamber is operated at a pressure gradient so that the vapors are pulled into the chamber. The close proximity of the chamber to the material minimizes the dilution of the vapors as the vapors are pulled into the chamber. In addition to the gap, the dilution of the vapor component may also be minimized by using mechanical features, such as extensions 35, 37 in FIGS. 2–4, added to the chamber. The extension may also provide side seals when extending beyond the web and contacting against the hot platen 24.

In accordance with the present invention, it is preferred that the total mass flow is selected to closely match the generation rate of gas phase components from the material. This will assist in preventing either the dilution or loss of vapor components. The total volumetric flow rate from the chamber is preferably at least 100% of the volumetric flow of the vapor component. Additionally, the present invention is capable of achieving substantially uniform flow across the inlet surface of the chamber. This may be achieved when a head space is present in the chamber above a layer of porous media. In the noted case, the pressure drop laterally in the head space is negligible with respect to the pressure drop through the porous media. One skilled in the art will recognize that the head space and pore size of porous media may be adjusted to adjust the flow rate across the inlet surface of the chamber.

In another preferred embodiment, the chamber of the present invention may be incorporated with a conventional gap drying system. Gap drying is a system which uses direct solvent condensation in combination with conduction dominant heat transfer and therefore does not require the use of applied forced convection to evaporate and carry away the solvent vapors. A gap dryer, consists of a hot plate and a cold plate separated by a small gap. The hot plate is located adjacent to the uncoated side of the web, supplying energy to evaporate the coating solvents. The cold plate, located adjacent to the coated side, provides a driving force for condensation and solvent vapor transport across the gap. The cold plate is provided with a surface geometry which prevents the liquid from dripping back onto the coated surface. The drying and simultaneous solvent recovery occurs as the coated substrate is transported through the gap between the two plates. Gap drying systems are fully described in U.S. Pat. Nos. 6,047,151, 4,980,697, 5,813,133, 5,694,701, 6,134,808 and 5,581,905 herein incorporated by reference in their entirety.

Figure 5A:
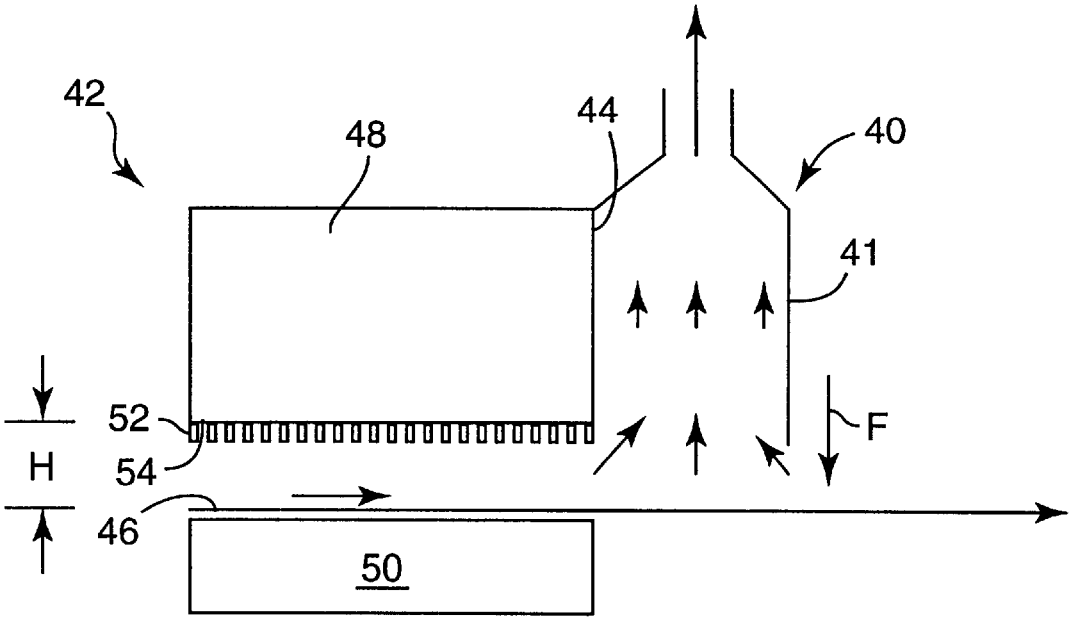
FIG. 5*a* is a schematic view of one preferred embodiment of the present invention in combination with a gap drying system.

The chamber may be positioned at several optional points in the gap drying system. For example, a chamber may be placed at either opposing ends of the gap dryer, internally within the gap dryer or combinations thereof. FIG. 5*a* shows the chamber 40 positioned at the trailing edge 44 of the gap drying system 42.

In conventional gap drying type configurations, some gas phase components are transported by drag from a moving web. The gas phase components in the gap between the web and the top plate can be a concern because it may be nominally saturated with the evaporative component. This component (solvent or other component) can be of concern because of environmental, health or safety considerations. When the gap is small enough, the volume of this Exhaust Flow Q can be readily calculated from the web speed Vweb, the top gap height, hu, and the film/web width W:

$$Q=(½)(V_{web})(W)(h_u)$$

For example, for a 0.508 meters/second web speed, with 1.53 meters width and a 0.0492 cm gap, this means a flow of 0.00123 cubic meters per second. This is a small and much more manageable flow to consider than with other more conventional drying means with gas phase flows of several orders of magnitude higher than the present invention.

Thus the chamber of the present invention is a suitable means for transporting and collecting the relatively small volume of mass in the adjacent gas phase of the web material. The basic embodiment is illustrated in FIG. 5*a*. A gap drying system 42 includes a web 46 positioned between a condensing plate 48 and a hot plate 50. A gap, of distance H, is formed between the upper surface of the web 46 and the condensing plate 48. The condensing plate 48 includes a capillary surface 52 to convey condensed material away from the condensing surface 54. A chamber 40 is provided at the point where the web 46 exits the gap to collect the gas phase components exiting the gap drying system 42.

The mass flow through the chamber may be assisted by applying a seal to a trailing edge of the chamber. The seal functions as a sweep to prevent gas from exiting the trailing edge of the chamber, thus forcing it into the chamber. The seal could include either a forced gas or mechanical seal. FIG. 5*a* depicts an optional forced gas air flow F in the direction of the downward arrow on the outer portion 41 of the chamber. The forced gas blocks any gas phase components carried by the moving web 46. The gas could be clean air, nitrogen, carbon dioxide or other inert gas systems.

Figure 5B:
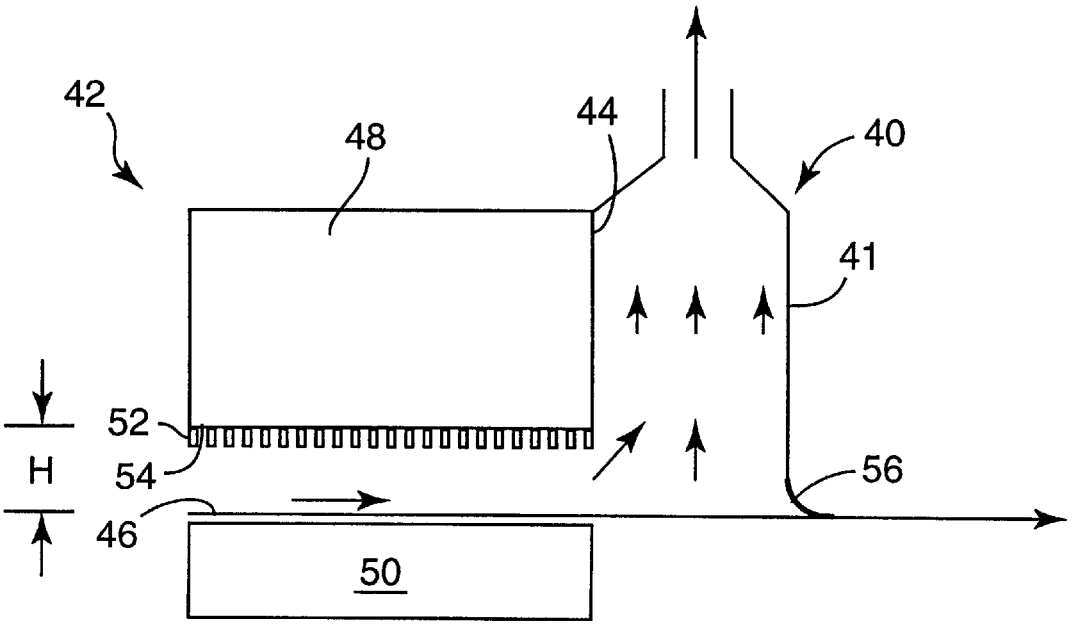
FIG. 5*b* is a schematic view of one preferred embodiment in combination with an optional mechanical seal.

A mechanical seal may also be utilized for forcing gas phase components into the chamber. FIG. 5*b* illustrates the utilization of a flexible seal element 56 at the outer portion 41 of the chamber 40 to reduce the amount of dilution transported through the chamber 40. The flexible seal 56 could drag on the web 46 or be spaced at a small gap to the web 46. In this case, the gap is non-uniform, with H at the exit near the seal approaching zero.

Figure 6:
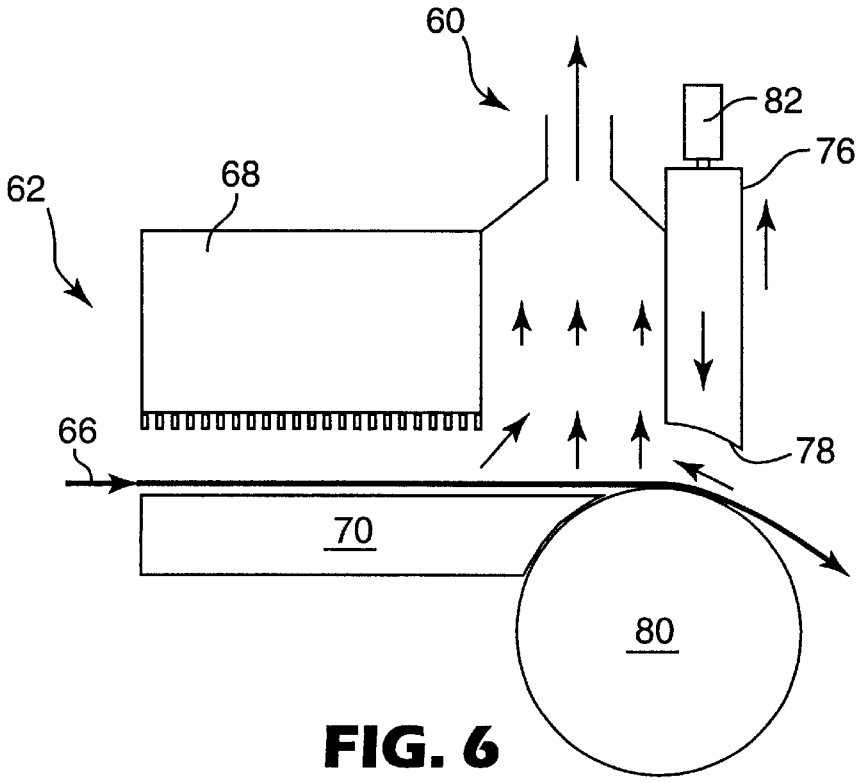
FIG. 6 is a schematic view of one preferred embodiment in combination with an optional retractable mechanical seal.

The mechanical seal may also comprise a retractable sealing mechanism as depicted in FIG. 6. The retractable sealing mechanism 76 is shown in an engaged position for normal continuous operation with a chamber 60 and a gap drying system 62, including condensing plate 68 and hot plate 70. In this arrangement, the retractable sealing mechanism 76 may be set at a smaller gap to the surface of the web 66 than with other forms of mechanical seals. The smaller gap is more effective in removing the boundary layer of gas phase components from the moving web 66 for capture without possible scratching or damaging the coating or web surface. This gap to the surface of the web 66 could be 0.00508 cm to 0.0508 cm or more. The smaller the gap, the more effective in removing the boundary layer of gas phase components. The effectiveness of the retractable sealing mechanism 76 is improved by increasing the thickness of the seal while maintaining a sealing face 78 that corresponds to the web at the sealing point. With an idler roll 80 as shown in the FIG. 6, the retractable sealing mechanism 76 has a radiused shape corresponding to the radius of the idler roll 80. The thickness of the retractable sealing mechanism could be 1.5 cm to more than 3 cm. The thicker the plate, the greater the sealing area and thus more effective. The practical thickness will depend on factors such as idler radius and idler wrap angle. The seal may be moved to a retracted position through use of an actuator 82 or other mechanical means. The raised arrangement prevents contamination to the sealing mechanism 76, damage to the web 66, allows passage of overthick coatings, or allows passage of a splice or other upset condition. Those skilled in the art recognize that the retraction of the retractable sealing mechanism 76 could be automated and controlled for known upsets such as splices or coating overthicknesses, or even connected to a sensor (not shown) for upsets (such as a tip bar, laser inspection device etc.) to allow retraction for unanticipated events.

The apparatus of the present invention utilizes a material supporting mechanism for securing the material in close proximity to the chamber to ensure an appropriate gap. Conventional material handling systems and devices are suitable for use with the present invention.

The apparatus includes a chamber, as described above, which is then placed over the material to define a gap between a surface of the material and the lower periphery of the chamber. The chamber is constructed of conventional materials and may be designed to meet specific application standards. The chamber may exist as a stand-alone device or it may be placed in an enclosed environment, such as, for example, an oven enclosure. Additionally, the flame arresting devices and heating coils optionally placed in the chamber may include conventional recognized equipment and materials.

An energy source, as described above, is used to provide sufficient energy to the material in order to vaporize the at least one evaporative component in the material. Heating and heat transfer equipment generally recognized in the art are suitable for use with the present invention.

The concentrated vapor stream collected in the chamber may be further separated utilizing conventional separation equipment and processes generally described as absorption, adsorption, membrane separation or condensation. Those skilled in the art are capable of selecting specific separation practices and equipment based on the vapor composition and desired separation efficiency.

In operation, the present invention captures at least a portion of the vapor component without substantial dilution and without condensation of the vapor component in the drying system. The collection of the vapor component at high concentrations permits efficient recovery of the material. The absence of condensation in the drying system reduces product quality issues involved with condensate falling onto the product. The present invention also utilizes relatively low air flow which significantly reduces the introduction of extraneous material into the drying system and thus prevents product quality problems with the finished product.

EXAMPLES

Example 1

Figure 7:
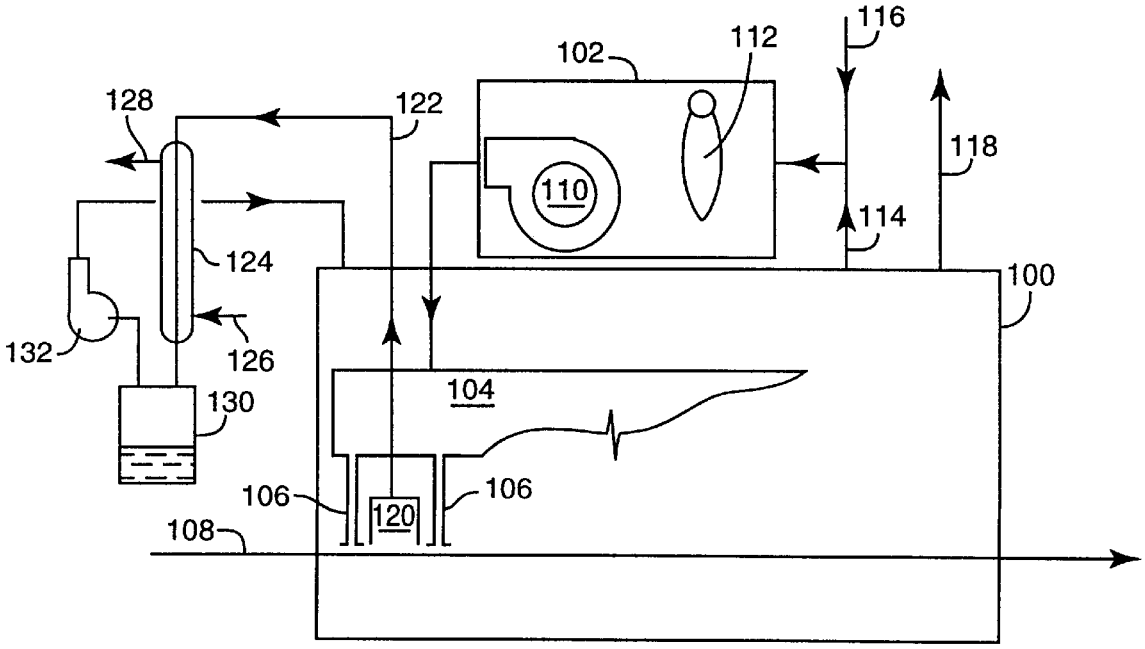
FIG. 7 is a schematic view of another preferred embodiment of a gas phase collection system and apparatus as described in the Example provided herein.

With reference to FIG. 7, an oven 100, with a direct fired heater box 102 was utilized in the present Example. The oven 100 had a supply air plenum 104 with multiple high velocity nozzles 106. These high velocity convection nozzles 106 were placed within 2.5 cm from the substrate material 108. The material 108 was a web of plastic film having a semi-rigid vinyl dispersion coated on the surface. The high velocity nozzles 106, provided high heat transfer to the material 108. The discharge air velocity at the nozzle exit was 20–30 meters per second at the oven temperature. The heater box had a recirculation fan 110, and a modulating direct fired burner 112. The heater box mixed the recirculation air 114, and fresh make up air 116, and passed this through the heater box 102. The direct fired burner 112, was modulated to control discharge air temperature at 150° to 200° C. The desired operating pressure of the oven is maintained by controlling oven exhaust 118, and the make up air 116. Chamber 120, is a 10 cm by 10 cm by 200 cm long structure made out of stainless steel. Multiple chambers (not shown), were mounted within 1.5 cm from the material 108 throughout the oven 100. Each chamber 120 had three 1.2 cm outlets at the top. The three outlets are joined in a 2 cm in diameter manifold 122. The manifold 122, was 2 cm in diameter and penetrated through the oven casing to outside the oven 100. The manifold 122, outside the oven body was connected to a condenser 124. The condenser 124 was a tube within a tube design and was made out of stainless steel. The inner tube was 2 cm in diameter and the outer tube was 3.5 cm in diameter. The condenser 124, had 2 cm in diameter plant chilled water inlet 126, and a 2 cm in diameter chilled water outlet 128. The plant chilled water was at 5°–10° C. at the chilled water inlet 126. A vapor component from the material 108 was collected within chamber 120, subsequently condensed in condenser 124, and then collected in a separator 130. Clean gaseous flow from the separator 130, was routed to a vacuum pump 132 through a 2 cm in diameter PVC pipe. The vacuum pump 132 was controlled to maintain chamber 120, at a pressure gradient with respect to the oven operating pressure. The discharge of the vacuum pump 132 was routed back to the oven body. This method collects substantial amount of vaporized components from the material 108 without substantial dilution. Material build up was observed in the internal area of the oven 100 after 4000 hours of operation. This corresponds to an approximate 100% improvement from the conventional system.

Examples 2-5

The comparison table below, Table 1, provides example calculations for different systems at typical equipment configurations and operating conditions. The definitions for M1, M2, M3, and M4 are the same as described above. M5 represents the time-average mass flow per unit width of any additional dilution stream provided to the chamber (for example the makeup air stream in convection ovens) in kg/second/meter. The width ("w") of the material, in centimeters, is the measurement (of the gap) in the direction perpendicular to the motion of the material. The time-average gas phase velocity ("<v>") was defined above and has units of meters per second. The pressure difference ("ΔP") is the pressure gradient between the lower periphery of the chamber and outside the chamber in Pascals. The material velocity ("V") is measured in meters per second.

The average velocity of gas phase components through the gap, <v>, can be measured using a velocity meter such as a hot wire anemometer, calculated from Equation 1 along with knowing the system gap cross sectional area, or estimated using $$\langle v\rangle = 1.288\sqrt{|\Delta p|}. \qquad \text{(Equation 2)}$$

The relationship between volumetric flow, Q, and mass flow, M, is M=ρQ where ρ is the density of the gas phase components in kilograms per cubic meter. The gas phase temperature dependence can be incorporated by substitution of the Ideal Gas Law resulting in $$M = \left(\frac{MWp}{RT}\right)Q, \qquad \text{(Equation 3)}$$

wherein MW is the molecular weight of the gas phase, p is the pressure, R is the gas constant, and T is the gas phase temperature. The dilution flow M1 can be computed using Equation 1, if it is the only unknown, or calculated from using the following equation $$M1 = \rho H\langle v\rangle. \qquad \text{(Equation 4)}$$

Comparative Example 2

A typical air convection drying system consisted of a large enclosure containing high velocity convection nozzles. The material, in web form, entered through an entrance gap having a width of 76.2 cm and a height of 10.2 cm. The material exited through an exit slot having the same dimensions as the entrance gap. The material was transported through the center of the gap at a velocity of about 1 meter/second. The material consisted of a polyester web with an organic solvent based coating and was dried as it passed through the enclosure. The dryer system operating conditions were as follows. The overall recirculation flow within the chamber of 18.6 kg/second/meter and with the enclosure (chamber) pressure set to −5 Pa. The exhaust flow through the chamber M4 was 7.43 kg/second/meter. The flow through the entrance and exit gaps and into the chamber, M1, resulting from the −5 Pa pressure gradient, was 0.71 kg/second/meter. M1 was calculated using Equation 4. The flow resulting from the evaporation of the coating solution solvents, M2, (i.e., drying) was 0.022 kg/seconds/meter. The M2 value was calculated assuming the flow stream, M4, was maintained at 20% Lower Flammability Limit (LFL) for a solvent with LFL of 1.5% by volume solvent concentration. The net flow into the gap resulting from the motion of the material through the chamber, M3, was 0. The flow of make up air M5 into the chamber was 6.7 kg/second/meter. The total net average gas phase velocity through the gap was calculated using Equation 2, $\langle v\rangle$=2.9 m/sec. The calculated value was verified by measurements obtained using a hotwire anemometer.

Comparative Example 3

A typical inert convection drying system consisted of a large enclosure containing high velocity convection nozzles. The material entered through an entrance gap having a width of 76.2 cm and a height of 2.54 cm. The material exited through an exit gap having the same dimensions as the entrance gap. The material was transported through the center of the gaps at a velocity of 1 meter/second. The material consisted of a polyester web with a organic solvent based coating and was dried as it passed through the enclosure. The dryer system operating conditions were as follows. The overall recirculation flow within the chamber of 5.66 kg/second/meter and with the enclosure pressure set to 2.5 Pa. The exhaust flow through the chamber M4 was 1.48 kg/second/meter. The flow through the entrance and exit gaps out of the chamber, M1, resulting from the positive 2.5 Pa pressure gradient was 0.12 kg/second/meter. M1 was calculated using Equation 4. The flow resulting from the evaporation of the coating solution solvents, M2, (i.e., drying) was 0.03 kg/second/meter. This was determined from the 2% by volume of solvent recovered (at the separation device) out of M4 prior to being returned to the dryer as part of dilution stream M5. The net flow into the gap resulting from the motion of the material through the chamber, M3, was 0. The additional dilution stream M5, was 1.57 kg/second/meter. This was made up of return flow from the separation device and the inert gas makeup stream. The total net average gas phase velocity through the gap was calculated using Equation 2, $\langle v \rangle$=2 m/sec.

Example 4

In this example the vapor collection apparatus was integrated with a conventional gap drying system to capture and collect the gas phase components exiting the gap dryer. The web was conveyed by a conveying system through the apparatus of the present invention. The web was comprised of polyester film coated with inorganic material dispersed in ethanol and water. The web entered through an entrance gap having a width, w, of 30.5 cm and a height, H, of 0.32 cm. The material exited through an exit gap having the same dimensions as the entrance gap. The web was transported through the gap and underneath the chamber at a velocity of 0.015 meter/second. The exhaust flow M4 was measured to be 0.0066 kg/second/meter. The flow through the entrance and exit gaps out of the chamber, M1, resulting from the induced pressure gradient was approximately the same, 0.0066 kg/second/meter. M1 was calculated using Equation 1. The web and coating were for all practical purposes dry upon exiting the gap dryer, thus M2 was 0. This was verified using a standard redry measurement where a sample of the web and coating displayed virtually no weight loss while being redried at an elevated temperature. The net flow into the gap resulting from the motion of the material through the chamber, M3, was 0 and there were no additional dilution streams M5. The average gas phase velocity through the gap was calculated from Equations 1 and 4, $\langle v \rangle$=0.086 m/sec. The pressure gradient was calculated to be 0.0045 Pa using Equation 2.

Example 5

In this example, a web was conveyed by a conveying system through apparatus substantially similar to that disclosed in FIGS. 2–4. The web was comprised of polyester film coated with a material consisting of a 10% styrene butadiene copolymer solution in toluene. The web passed under a chamber thereby forming a gap between the lower periphery of the chamber and the exposed surface of the material. The gap had a width, w, of 15 cm and a height, H, of 0.32 cm. The material exited from underneath the chamber at a gap having the same dimensions as the entrance gap. The web was transported through the gap and underneath the chamber at a velocity of 0.0254 meter/second. The dryer system operating conditions were as follows. The heating element was maintained at 87° C. and the chamber was maintained at 50° C. The exhaust flow (M4) was measured to be 0.00155 kg/second/meter. The flow through the entrance and exit gaps out of the chamber, M1, resulting from the induced pressure gradient was 0.00094 kg/second/meter. M1 was calculated using Equation 1. The flow resulting from the evaporation of the toluene, M2, was 0.00061 kg/second/meter. The net flow into the gap resulting from the motion of the material through the chamber, M3, was 0. There was no additional dilution streams M5. The total net average gas phase velocity through the gap was calculated from Equations 1, 3, and 4 $\langle v \rangle$=0.123 m/sec.

TABLE 1

| Example | M4 Kg/sec/m | M3 kg/sec/m | M2 Kg/sec/m | M1 Kg/sec/m | M5 kg/sec/m | H Cm | w cm | $\langle v \rangle$ m/sec | Δp Pa | V m/Sec |
|---|---|---|---|---|---|---|---|---|---|---|
| 2. Air Convection Drying System | 7.43 | 0 | 0.022 | 0.71 | 6.7 | 10.2 | 76.2 | 2.9 | −5 | 1 |
| 3. Inert Convection Drying System | 1.48 | 0 | 0.03 | −0.12 | 1.57 | 2.54 | 76.2 | 2 | 2.5 | 1 |
| 4. Exhaust Port | 0.0066 | 0 | ≈0 | ≈0.0066 | 0 | 0.32 | 30.5 | 0.086 | ≈−0.0045 | 0.015 |
| 5. Drying System | 0.00155 | 0 | 0.00061 | 0.00094 | 0 | 0.32 | 15 | 0.123 | ≈−0.009 | 0.0254 |

From the above disclosure of the general principles of the present invention and the preceding detailed description, those skilled in this art will readily comprehend the various modifications to which the present invention is susceptible. Therefore, the scope of the invention should be limited only by the following claims and equivalents thereof.

What is claimed is:

1. A method comprising (a) providing at least one material having at least one major surface with an adjacent gas phase;

(b) positioning a chamber in close proximity to said surface of said material to define a gap between said chamber and said surface, wherein said adjacent gas phase between said chamber and said surface define a region possessing an amount of mass; and (c) inducing transport of at least a portion of said mass from said region through said chamber, wherein M1 means total net time-average mass flow through said gap into said region and through said chamber resulting from pressure gradients, M2 means time-average mass flow from said at least one major surface of said material into said region, M3 means total net time-average mass flow through said gap into said region resulting from motion of said material, and M4 means time-average rate of mass transport through said chamber such that M1+M2+M3=M4; and for the present method M1 has a value greater than zero but not greater than 0.25 kg/second/meter.

2. A method according to claim 1, wherein the temperature in said chamber is controlled to prevent phase change of components in said mass.

3. A method according to claim 1, wherein the material is a web.

4. A method according to claim 1, further comprising separating a vapor component from said mass transported through said chamber.

5. A method according to claim 4, wherein separation includes absorption, adsorption, membrane separation or condensation.

6. A method according to claim 4, wherein temperature of said vapor component is controlled to prevent condensation of vapor prior to separation.

7. A method according to claim 1, further comprising a destruction device in communication with said chamber for receiving said mass.

8. A method according to claim 1, wherein said gap is 3 cm or less.

9. A method according to claim 1, wherein said chamber includes at least one flame arresting mechanism.

10. A method according to claim 1, wherein M1 is no greater than 0.1 kg/second/meter.

11. A method according to claim 1, wherein the total net average velocity of M1 is no greater than 0.5 meters/second.

12. A method according to claim 1, wherein said material includes at least one evaporative component and energy is supplied to vaporize said evaporative component to form a vapor component in said mass of said adjacent gas phase.

13. A method according to claim 1, wherein one or more chambers are utilized to capture at least a portion of said vapor component.

14. A method according to claim 13, wherein each of said one or more chambers is independently controlled.

15. A method according to claim 12, wherein at least a portion of said vapor component is captured from said chamber at concentrations high enough to permit subsequent separation of said vapor component at a temperature of 0° C. or higher.

16. A method according to claim 1, wherein said time-average rate of mass transport through said region is at least 100% of said time-average mass flow from said at least one major surface of said material into said region.

17. A method according to claim 12, wherein said vapor component is flammable and is captured at a concentration of at least the upper flammability limit.

18. A method according to claim 1, wherein said chamber is in an enclosed environment.

19. A method comprising;

(a) providing at least one material having at least one major surface with an adjacent gas phase;

(b) positioning a chamber in close proximity to said surface of said material to define a gap between said chamber and said surface, wherein said adjacent gas phase between said chamber and said surface define a region possessing an amount of mass; and (c) inducing transport of at least a portion of said mass from said region through said chamber, wherein M1 means total net time-average mass flow through said gap into said region resulting from pressure gradients, M2 means time-average mass flow from said at least one major surface of said material into said region, M3means total net time-average mass flow through said gap into said region resulting from motion of said material, and M4 means time-average rate of mass transport through said chamber such that M1+M2+M3=M4; and for the present method the total net average velocity of M1 is no greater than 0.5 meters/second.

20. A method according to claim 19, wherein M1 has a value greater than zero but not greater than 0.25 kg/second/meter.

21. A method according to claim 19, wherein the temperature in said chamber is controlled to prevent phase change of components in said mass.

22. A method according to claim 19, wherein the material is a web.

23. A method according to claim 19, further comprising separating a vapor component from said mass transported through said chamber.

24. A method according to claim 23, wherein separation includes absorption, adsorption, membrane separation or condensation.

25. A method according to claim 23, wherein temperature of said vapor component is controlled to prevent condensation of vapor prior to separation.

26. A method according to claim 19, wherein said gap is 3 cm or less.

27. A method according to claim 19, wherein said chamber includes at least one flame arresting mechanism.

28. A method according to claim 19, wherein said material includes at least one evaporative component and energy is supplied to vaporize said evaporative component to form a vapor component in said mass of said adjacent gas phase.

29. A method according to claim 19, wherein one or more chambers are utilized to capture at least a portion of said vapor component.

30. A method according to claim 29, wherein each of said one or more chambers is independently controlled.

31. A method according to claim 19, wherein said chamber is in an enclosed environment.

32. A method comprising;

(a) providing at least one material having at least one major surface with an adjacent gas phase, said material including at least one evaporative component;

(b) positioning a chamber in close proximity to said surface of said material to define a gap between said chamber and said surface, wherein said adjacent gas phase between said chamber and said surface define a region possessing an amount of mass;

(c) supplying energy to vaporize said at least one evaporative component to form a vapor component in said mass of said adjacent gas phase; and (d) inducing transport of at least a portion of said mass from said region through said chamber, wherein M1 means total net time-average mass flow through said gap into said region resulting from pressure gradients, M2 means time-average mass flow from said at least one major surface of said material into said region, M3 means total net time-average mass flow through said gap into said region resulting from motion of said material, and M4 means time-average rate of mass transport through said chamber such that M1+M2+M3=M4; and for the present method M1 has a value greater than zero but not greater than 0.25 kg/second/meter.

33. A method according to claim 32, wherein said chamber is positioned at one or both of opposing ends of a gap drying apparatus.

34. A method according to claim 32, wherein said chamber is positioned within a gap drying apparatus.

35. A method according to claim 32, wherein said material is a web.

36. A method according to claim 32, further comprising sealing one end of said chamber in order to force said adjacent gas phase into said region.

37. A method according to claim 36, wherein said sealing is accomplished by forced gas or a mechanical seal.

38. A method according to claim 37, wherein said mechanical seal is moveable.

39. A method comprising:

(a) providing at least one material having at least one major surface with an adjacent gas phase;

(b) positioning a chamber in close proximity to at least one end of a gap drying apparatus, internally to a gap drying apparatus, or combinations thereof, said chamber in close proximity to said surface of said material to define a gap between said chamber and said surface, wherein said adjacent gas phase between said chamber and said surface define a region possessing an amount of mass; and (c) inducing transport of at least a portion of said mass from said region through said chamber, wherein M1 means total net time-average mass flow through said gap into said region resulting from pressure gradients, M2 means time-average mass flow from said at least one major surface of said material into said region, M3 means total net time-average mass flow through said gap into said region resulting from motion of said material, and M4 means time-average rate of mass transport through said chamber such that M1+M2+M3=M4; and for the present method M1 has a value greater than zero but not greater than 0.25 kg/second/meter.

40. An apparatus comprising;

(a) a support mechanism for supporting material, said material having at least one major surface with an adjacent gas phase;

(b) a chamber positioned in close proximity to a surface of said material to define a gap between said chamber and said surface, wherein said adjacent gas phase between said chamber and said surface define a region possessing an amount of mass; and (c) a mechanism in communication with said chamber to induce transport of at least a portion of said mass from said adjacent gas phase through said region, wherein M1 means total net time-average mass flow through said gap into said region resulting from pressure gradients, M2 means time-average mass flow from said at least one major surface of said material into said region, M3 means total net time-average mass flow through said gap into said region resulting from motion of said material, and M4 means time-average rate of mass transport through said chamber such that M1+M2+M3=M4; and for the present method M1 has a value greater than zero but not greater than 0.25 kg/second/meter.

41. An apparatus according to claim 40, further comprising a separating mechanism in communication with said chamber for separating individual components from said mass transported through said chamber.

42. An apparatus according to claim 41, wherein separation occurs through absorption, adsorption, membrane separation or condensation.

43. An apparatus according to claim 40, wherein said material includes at least one evaporative component and said apparatus includes an energy source capable of providing sufficient energy to vaporize said at least one evaporative component to form a vapor component in said adjacent gas phase.

44. An apparatus according to claim 43, wherein said chamber includes a heating device to prevent condensation of said vapor component.

45. An apparatus according to claim 43, wherein energy is imparted to the material before being positioned near said chamber.

46. An apparatus according to claim 40, wherein said material is a web and said web is continuously conveyed past said chamber.

47. An apparatus according to claim 40, wherein the chamber includes a flame arresting device.

48. An apparatus according to claim 40, further comprising a sealing mechanism on one end of said chamber in order to force said adjacent gas phase into said region.

49. An apparatus according to claim 40, wherein said chamber is located on at least one opposing end of a gap drying system, internal to a gap drying system, or combinations thereof.

* * * * *